US008794924B2

(12) United States Patent
Tsumura et al.

(10) Patent No.: US 8,794,924 B2
(45) Date of Patent: Aug. 5, 2014

(54) ROTATING BODY

(75) Inventors: Yoichiro Tsumura, Tokyo (JP); Kyoichi Ikeno, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 487 days.

(21) Appl. No.: 12/832,152

(22) Filed: Jul. 8, 2010

(65) Prior Publication Data

US 2011/0008171 A1 Jan. 13, 2011

(30) Foreign Application Priority Data

Jul. 13, 2009 (JP) ..... 2009-164780

(51) Int. Cl.
*F01D 5/32* (2006.01)

(52) U.S. Cl.
USPC ..... 416/215

(58) Field of Classification Search
USPC ..... 416/215, 216, 218, 220 R
See application file for complete search history.

(56) References Cited

U.S. PATENT DOCUMENTS

| | | | | |
|---|---|---|---|---|
| 1,371,327 | A * | 3/1921 | Schneider | 416/215 |
| 2,406,703 | A * | 8/1946 | Morris | 416/216 |
| 5,435,693 | A * | 7/1995 | Shaffer | 416/204 A |
| 5,522,706 | A * | 6/1996 | Mannava et al. | 416/215 |
| 6,893,224 | B2 * | 5/2005 | Murphy | 416/220 R |
| 7,168,919 | B2 * | 1/2007 | Blatchford et al. | 416/215 |
| 7,410,345 | B2 * | 8/2008 | Bracken | 416/215 |
| 7,500,832 | B2 * | 3/2009 | Zagar et al. | 416/221 |

FOREIGN PATENT DOCUMENTS

| | | |
|---|---|---|
| JP | 49-138202 | 11/1974 |
| JP | 59-105001 | 7/1984 |
| JP | 10-306703 | 11/1998 |
| JP | 11-350903 | 12/1999 |
| JP | 2003-526039 | 9/2003 |
| JP | 2004-108290 | 4/2004 |

OTHER PUBLICATIONS

Japanese Office Action issued May 31, 2011 in corresponding Japanese Patent Application No. 2009-164780 w/English translation.

* cited by examiner

*Primary Examiner* — Nathaniel Wiehe
*Assistant Examiner* — Brian O Peters
(74) *Attorney, Agent, or Firm* — Wenderoth, Lind & Ponack, L.L.P.

(57) ABSTRACT

A rotating body includes a rotor disk 10 that has a moving blade fitting groove 11 that is annularly provided along the outer circumference and a moving blade lead-in hole 12 that is provided in the outer circumference and is in communication with the moving blade fitting groove 11; a plurality of moving blades 20 that are consecutively provided in the outer circumference and that each have a blade root 21 that is fitted in the moving blade fitting groove 11 and a wing body 23 that projects to the outer side of the rotor disk 10; two special moving blades 20A and 20B that each have a blade root 21 of which a portion is fitted in the moving blade fitting groove 11 and a wing body 23 that projects to the outer side of the rotor disk 10, and that by mutually adjoining block the moving blade lead-in hole 12; and a tensioning key 13 that is inserted between the moving blades 20, in which the tensioning key 13 is provided with an insertion portion whose thickness dimension in the circumferential direction gradually increases from one end on the inner side in the radial direction toward the other end on the outer side in the radial direction.

18 Claims, 10 Drawing Sheets

ROTATING BODY

BACKGROUND OF THE INVENTION

1. Field of the Invention

The present invention relates to a rotating body that is suitable for use in, for example, a rotor of a steam turbine.

Priority is claimed on Japanese Patent Application No. 2009-164780, filed Jul. 13, 2009, the content of which is incorporated herein by reference.

2. Description of Related Art

As is well known, a steam turbine that converts thermal energy of steam into kinetic energy by rotating a rotor with steam is widely employed in the driving of a compressor in power generation and chemical plants.

As a rotor that is used in this kind of steam turbine, there is one that is equipped with a rotor disk that is provided on the outer circumference of a rotor shaft, and a plurality of moving blades that are consecutively provided on the outer circumference of this rotor disk. In this kind of rotating body, it is necessary to firmly fix the rotor disk and the moving blades so as to be able to sufficiently tolerate the centrifugal force, vibration stress, and bending stress that arise during high-speed rotation.

For example, in Patent Document 1 given below, a rotating body is disclosed that is provided with a rotor disk that has a moving blade fitting groove that is annularly provided along the outer circumference and a moving blade lead-in hole that is provided in the outer circumference and is in communication with the moving blade fitting groove, moving blades that each have a blade root that is fitted in the moving blade fitting groove, a disk pin that passes through the blade root of the moving blade that is placed last at the moving blade lead-in hole and the rotor disk in the axial direction, and a blade pin that is provided within the moving blade that is placed last, interlocks with the disk pin and projects to both sides in the circumferential direction. That is, in this rotating body, the moving blade that is placed last and other moving blades are fixed by causing engagement of a hollow portion that is formed in both adjacent moving blades of the moving blade that is placed last and the blade pin.

[Patent Document 1] Japanese Unexamined Patent Application, First Publication No. 2004-108290

In order to achieve higher output and higher speed rotation of the steam turbine, it is necessary to fix the moving blades to the rotor disk with additional firmness so that the moving blades do not detach as a result of high-speed rotation. However, since in the prior art the moving blades are simply attached by causing engagement of the hollow portions that are formed in the moving blades and the blade pin of the moving blade placed last, even if the strength of the blade pin is increased or the formation dimensions are optimized, the fixing property of the moving blades is insufficient.

As a structure that is capable of firmly fixing the moving blades, it is possible to mention the following structure that is disclosed as prior art in the aforementioned Patent Document 1. That is, this structure is provided with a rotor disk that has a moving blade fitting groove and a moving blade lead-in hole, moving blades that each have a blade root, two special moving blades that are mutually adjacent and block the moving blade lead-in hole and in which a portion of each respective blade root fits in the moving blade fitting groove, and a tensioning key that is inserted between the moving blades. By inserting the tensioning key between the moving blades, the positions of the two special moving blades are adjusted, and by passing a stop pin through the blade roots of the special moving blades and the rotor disk, movement in the circumferential direction of the moving blades and the special moving blades is restrained.

In this kind of structure, since a portion of the blade roots of the special moving blades is fitted in the moving blade fitting groove, it is possible to firmly fix the moving blades and the special moving blades.

However, in the aforementioned structure, there is the problem in which the fixing property of the tensioning key must be increased so that the tensioning key does not detach as a result of high-speed rotation.

The present invention was achieved in view of the aforementioned circumstances, and has as its object to provide a rotating body in which the tensioning key and the moving blades and the special moving blades are firmly attached.

SUMMARY OF THE INVENTION

In order to achieve the aforementioned object, the present invention adopts the following means.

That is, the rotating body according to the present invention is a rotating body provided with: a rotor disk that has a moving blade fitting groove that is annularly provided along the outer circumference and a moving blade lead-in hole that is provided in the outer circumference and is in communication with the moving blade fitting groove; a plurality of moving blades that are consecutively provided in the outer circumference and that each have a blade root that is fitted in the moving blade fitting groove and a wing body that projects to the outer side of the rotor disk; two special moving blades that each have a blade root a portion of which is fitted in the moving blade fitting groove and a wing body that projects to the outer side of the rotor disk, and that by mutually adjoining block the moving blade lead-in hole; and a tensioning key that is inserted between the moving blades, in which the tensioning key is provided with an insertion portion whose thickness dimension in the circumferential direction gradually increases from one end on the inner side in the radial direction toward the other end on the outer side in the radial direction.

According to this constitution, since the tensioning key is provided with an insertion portion whose thickness dimension in the circumferential direction gradually increases from one end toward the other end, it is possible to increase the contact area of the plurality of blade roots in a radial shape and the tensioning keys. Thereby, it is possible to produce a large frictional force between the tensioning keys and the blade roots, and it is possible to improve the fixing property of the tensioning keys. Accordingly, even if the rotating body is subjected to high speed rotation, separation of the tensioning keys is suppressed, and as a result it is possible to prevent separation of the moving blades and the special moving blades.

Also, the insertion portion may be provided with contact faces that make contact over the entire surface with the end faces in the circumferential direction of the blade roots.

According to this constitution, since the insertion portion has contact faces that make contact over the entire surface with the end faces of the blade roots, it is possible to further increase the frictional force that is produced between the tensioning key and the moving blades.

Also, in the case of the peripheral length of the rotor disk being R, the total number of the moving blades and the special moving blades being Nb, the thickness dimension in the circumferential direction at the outermost portion of the blade root of the moving blades and special moving blades being tb, the number of tensioning keys being Nk, and the thickness dimension in the circumferential direction of the other end in the insertion portion of the tensioning key being tk, prior to assembling the rotor disk, the moving blades, the special moving blades, and the tensioning keys, the following relations may be satisfied:

$$R>Nb\times tb$$

$$R<Nb\times tb+Nk\times tk$$

According to this constitution, in the rotating body after assembly, the tensioning keys, the moving blades, and the special moving blades are respectively pressed, and by this pressing force it is possible to further increase the frictional force that is produced between the tensioning keys, the moving blades and the special moving blades.

Also, it is possible to allow large processing tolerances of the moving blades and the special moving blades.

Also, adjacent face of the blade roots of the two special moving blades may have semicircular grooves that extend in the axial direction, a through-hole that extends in the axial direction may be constituted by these two semi-circular grooves, the rotor disk, while having an insertion hole that penetrates the rotor disk in the axial direction and overlaps with the through-hole in the axial direction, may be provided with a stop pin that is inserted in the through-hole and the insertion hole to restrain the plurality of moving blades in the circumferential direction, and the stop pin may be fixed by at least one end portion thereof being crushed.

According to this constitution, since the end portion of the stop pin is fixed by being crushed, the stop pin does not easily fall out. Thereby, shifting in the circumferential direction and separation in the radial direction of the moving blades, the tensioning keys, and the special moving blades due to falling out of the stop pin are prevented, and it is possible to improve the fixing property of the tensioning key.

Also, it is characterized by the moving blades, the special moving blades, and the tensioning key may be formed with materials having the same linear expansion coefficient.

According to this constitution, since the moving blades, the special moving blades, and the tensioning key are all formed with material having the same linear expansion coefficient, it is possible to further improve the fixing property of the moving blades, the special moving blades, and the tensioning key. In other words, in the case of using the rotating body in a comparatively high temperature, it is possible to prevent damage due to looseness and thermal stress of the moving blades and the tensioning key that occurs due to differences in the thermal expansion amount, and so it is possible to improve the fixing property of the tensioning key, the moving blades, and the special moving blades.

Also, guide grooves in which the tensioning key is fitted may be formed in the side walls of the moving blade fitting groove.

According to this constitution, since the guide grooves in which the tensioning key is fitted are formed, during assembly of the rotating body, it is possible to readily distinguish the position to which the tensioning key is inserted.

Also, the moving blades and the special moving blades may be provided with a base plate that is provided between the wing body and the blade root, the tensioning key may be provided with an extension portion that is provided at the other end of the insertion portion and that extends in the axial direction of the rotor disk, and the base plate may have a crushing portion that covers a portion of the extension portion of the tensioning key that is adjacent.

According to this constitution, since the base plate has a crushing portion that covers a portion of the extension portion of the tensioning key, this crushing portion prevents separation of the tensioning key in the radial direction. That is, it is possible to increase the centrifugal force that occurs in the tensioning keys by the portion of the allowable shear load to the crushing portion. Thereby, it is possible to greatly increase the fixing property of the tensioning key.

Also, the extension portion may have beveled portions on outer side corner portions, and these beveled portions are filled by the crushing portion.

According to this constitution, since the extension portion has the beveled portions, and the crushing portion fills the beveled portions, it is possible to largely ensure the shear area, and it is possible to increase the allowable shear load of the crushing portion.

Effect of the Invention

According to the present invention, it is possible to provide a rotating body in which the tensioning key, the moving blades, and the special moving blades are firmly fixed.

DETAILED DESCRIPTION OF THE INVENTION

Hereinbelow, an embodiment of the present invention shall be described with reference to drawings.

Figure 1:
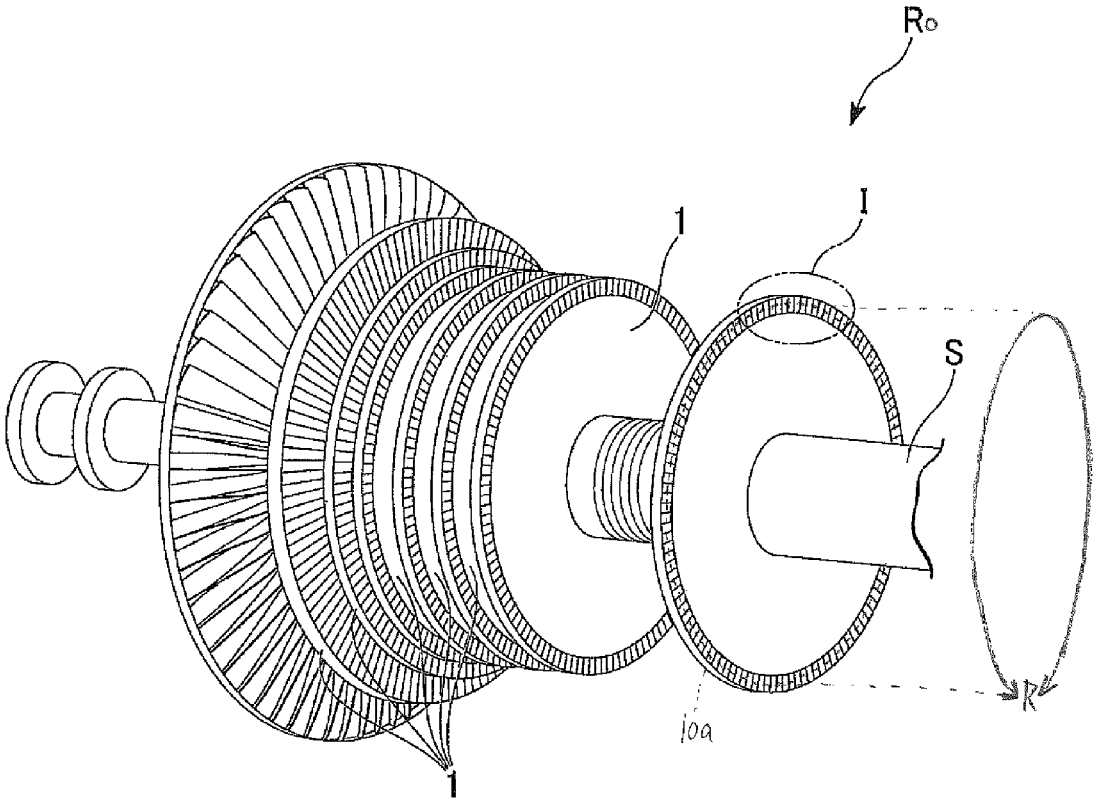
FIG. 1 is a schematic view that shows a rotor $R_O$ of a steam turbine according to an embodiment of the present invention.
Figure 2:
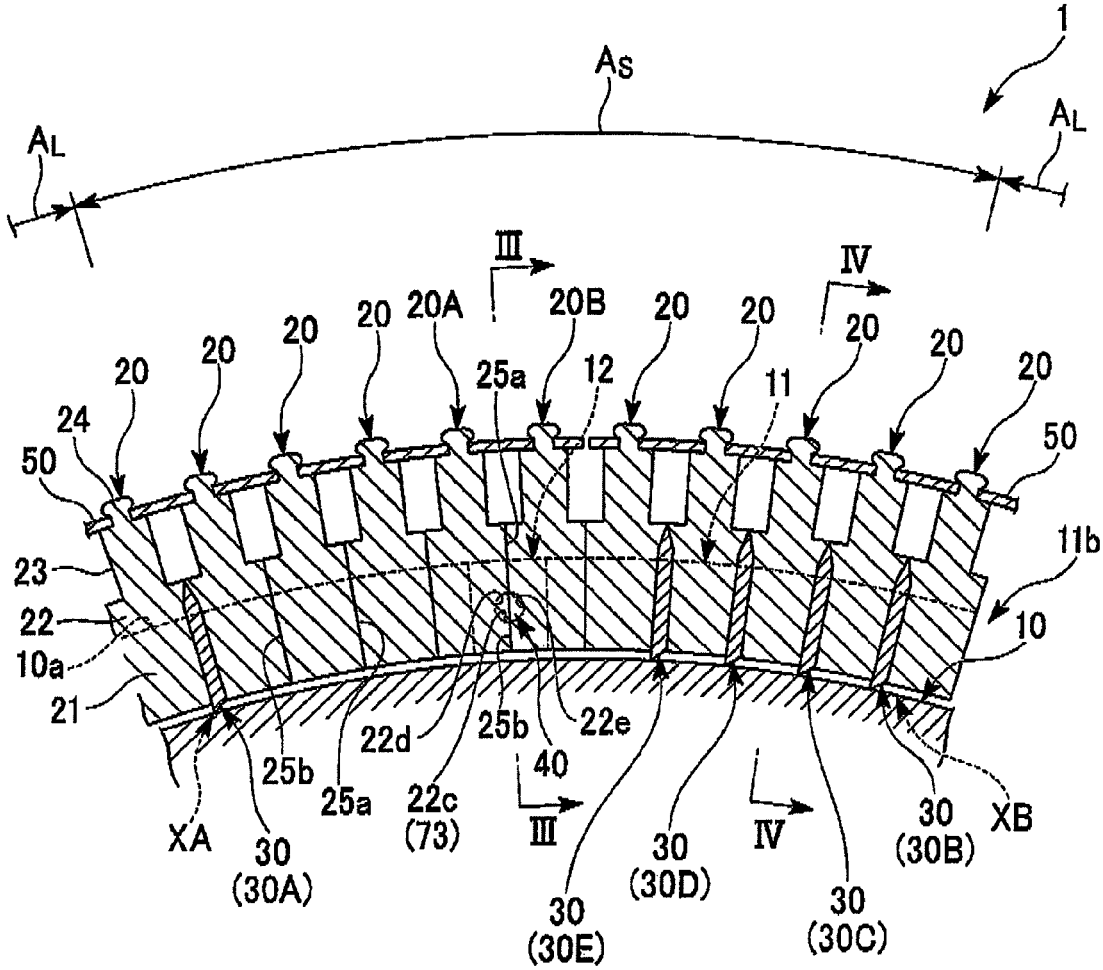
FIG. 2 is a principal portion enlarged cross-sectional view of a rotating body 1 according to an embodiment of the present invention, being an orthogonal cross-sectional view in the axial direction of the principle portion I in FIG. 1.

FIG. 1 is a schematic view that shows a rotor $R_O$ of a steam turbine according to an embodiment of the present invention, and FIG. 2 is an orthogonal cross-sectional view in the axial direction of the principle portion I in FIG. 1.

As shown in FIG. 1, this rotor $R_O$ is constituted with a plurality of rotating bodies 1 which are provided on the outer circumference of a rotor shaft S, and the rotor shaft S rotates together with these rotating bodies 1.

As shown in FIG. 2, the rotating body 1 is provided with a rotor disk 10, a plurality of moving blades 20, two special moving blades 20A and 20B, a plurality of tensioning keys 30, and a stop pin 40.

Figure 3:
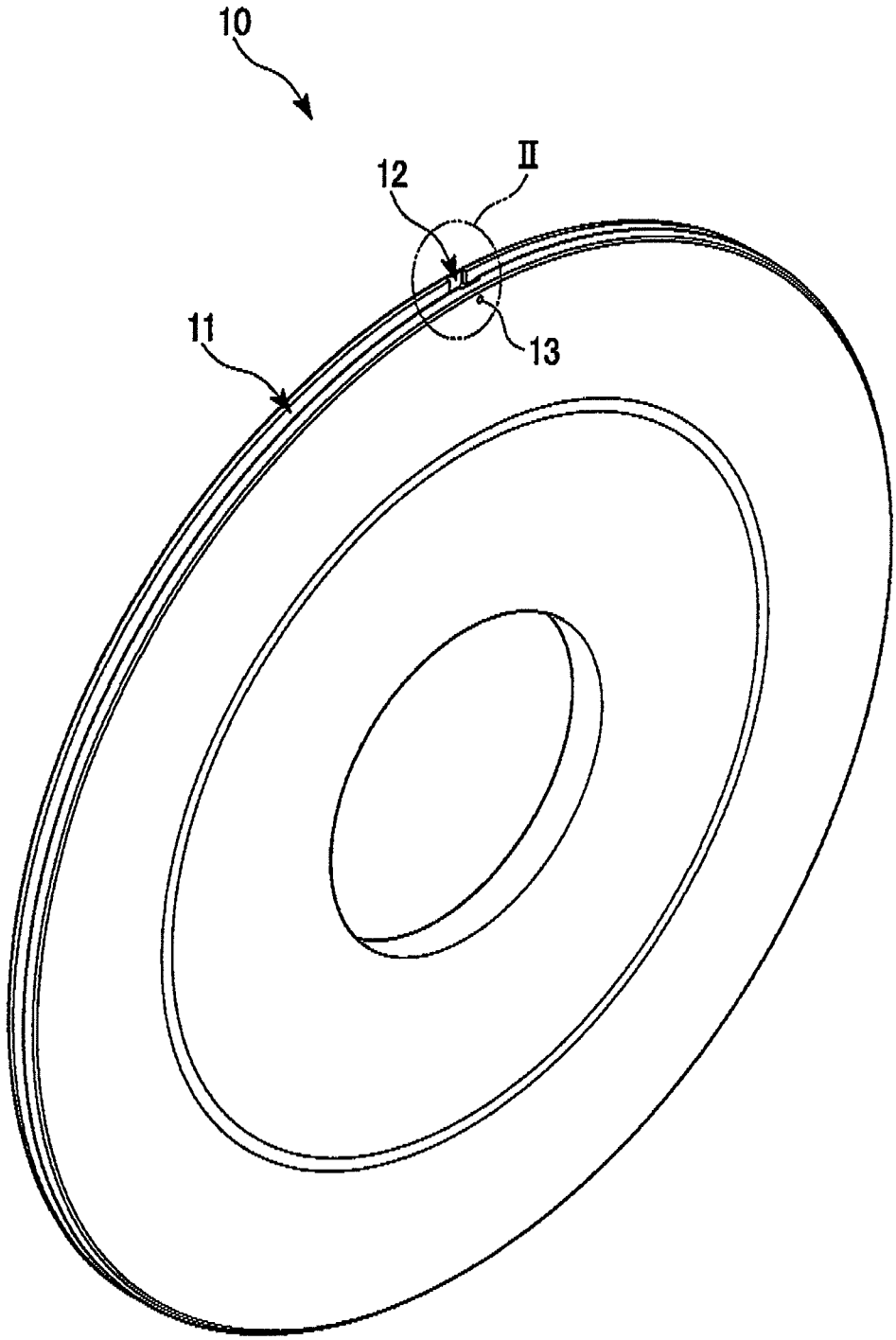
FIG. 3 is an external perspective view of a rotor disk 10 according to an embodiment of the present invention.
Figure 4:
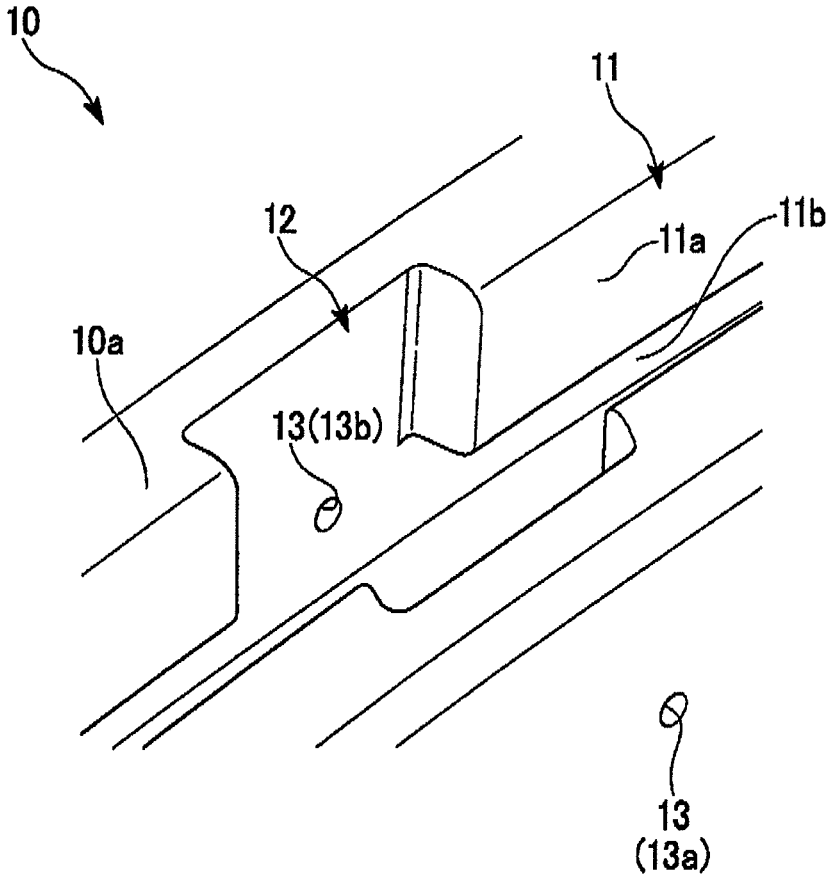
FIG. 4 is a principal portion enlarged view of a rotor disk 10 according to an embodiment of the present invention, being an enlarged perspective view of the principle portion II in FIG. 3.
Figure 5:
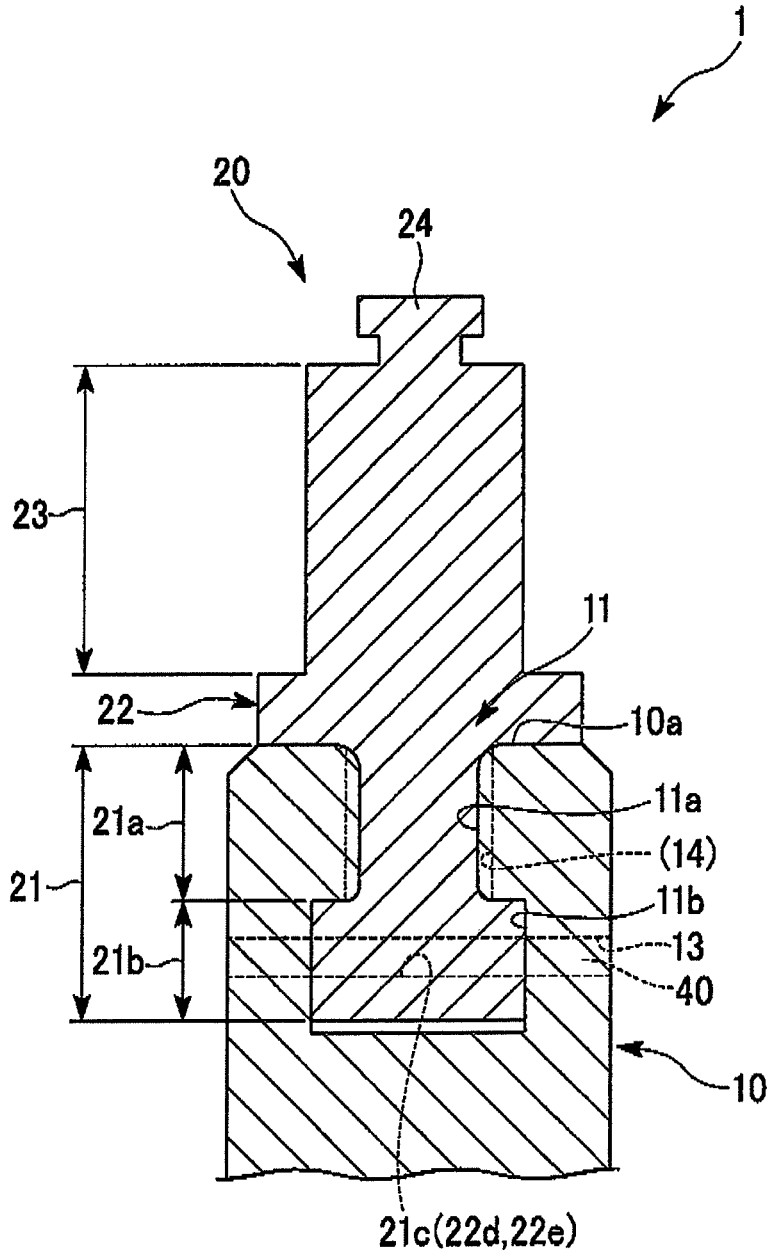
FIG. 5 is a principal portion enlarged cross-sectional view of a rotating body 1 according to an embodiment of the present invention, being a cross-sectional view along the line III-III in FIG. 2.
Figure 6:
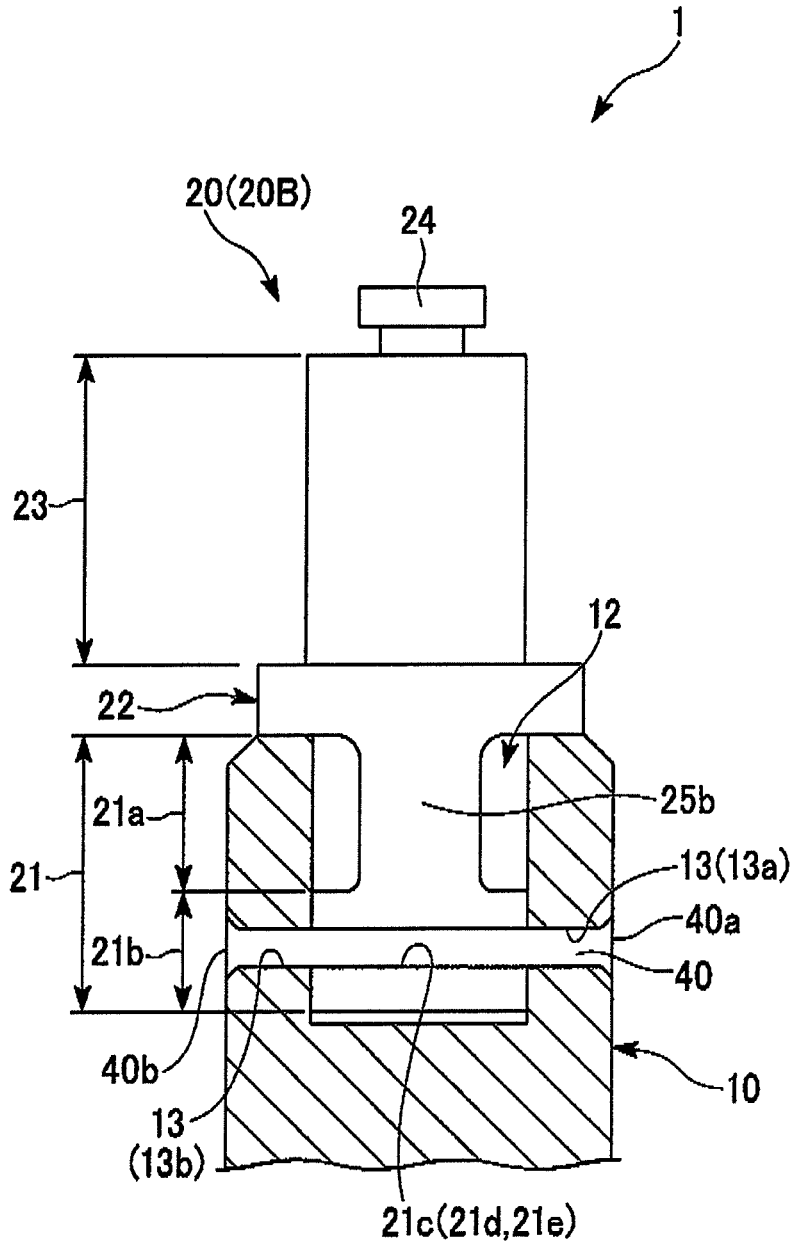
FIG. 6 is a principal portion enlarged cross-sectional view of a rotating body 1 according to an embodiment of the present invention, being a cross-sectional view along the line IV-IV in FIG. 2.

FIG. 3 is an external perspective view of the rotor disk 10, FIG. 4 is an enlarged perspective view of the principle portion II in FIG. 3, FIG. 5 is a cross-sectional view along the line III-III in FIG. 2, and FIG. 6 is a cross-sectional view along the line IV-IV in FIG. 2.

As shown in FIG. 3, the rotor disk 10 is a disk shaped member that is formed as a separate body from the rotor shaft S, and is shrink-fitted on the rotor shaft S.

This rotor disk 10 has a moving blade fitting groove 11, a moving blade lead-in hole 12, and an insertion hole 13.

As shown in FIG. 3, the moving blade fitting groove 11 is formed in an annular shape along the outer circumference of the rotor disk 10, and as shown in FIG. 5, is opened in the radial direction at the outermost circumference end face 10*a*. In the groove cross-section of the moving blade fitting groove 11, the groove width dimension (the axial direction dimension) is formed in two steps from the opening to the groove bottom as shown in FIG. 5, and consists of a narrow width portion 11*a* that is formed on the opening side and whose groove width dimension is made smaller, and a wide width portion 11*b* that is formed on the groove bottom side and whose groove width dimension is made larger. In other words, it is made into a groove cross-section with an inverted T shape.

As shown in FIG. 3, one moving blade lead-in hole 12 is formed in the outer circumference of the rotor disk 10, and as shown in FIG. 4, both end portions of the moving blade fitting groove 11 are continuous to the moving blade lead-in hole 12 in the circumferential direction.

This moving blade lead-in hole 12 is made capable of leading in one blade root (described below) of the moving blade 20, and the groove width dimension thereof is formed approximately constant from the opening toward the groove bottom. Also, the groove bottom is continuous with the groove bottom of the moving blade fitting groove 11, and the groove depth dimension (the dimension in the radial direction) is formed to be equivalent with the moving blade fitting groove 11.

As shown in FIG. 4, the insertion hole 13 (13*a* and 13*b*) penetrates the disk surface of the rotor disk 10 in the axial direction so as to communicate with the moving blade lead-in hole 12, and as shown in FIG. 6, the insertion hole 13*a* from one disk surface and the insertion hole 13*b* from other disk surface respectively penetrate through to the moving blade lead-in hole 12.

The plurality of moving blades 20 and the special moving blades 20A and 20B, as shown in FIG. 2, are provided in series on the outer circumference of the rotor disk 10.

As shown in FIG. 5 and FIG. 6, the moving blades 20 and the special moving blades 20A and 20B respectively have a blade root 21, a base plate 22, and a wing body 23.

The blade root 21 is constituted such that an inverse T-shaped cross section is continuous in one direction, and as shown in FIG. 5, joins with the moving blade fitting groove 11. More specifically, the blade root 21 consists of a shallow root portion 21*a* and a deep root portion 21*b*, with the shallow root portion 21 having approximately the same height dimension as the groove depth dimension of the narrow width portion 11*a* and approximately the same width dimension as the groove width dimension of the narrow width portion 11*a*, and the deep root portion 21*b* having a height dimension that is slightly smaller than the groove depth dimension of the wide width portion 11*b* and a width dimension that is the same as the groove width dimension of the wide width portion 11*b*.

The depth dimension of this blade root 21 (the dimension in the circumferential direction of the rotor disk 10) is made to be slightly smaller than the dimension in the circumferential direction of the moving blade lead-hi hole 12.

As shown in FIG. 5 and FIG. 6, the base plate 22 is a section that connects the blade root 21 and the wing body 23, and functions as a seat of the wing body 23.

This base plate 22 widens in the axial direction to cover most of the outer periphery of the rotor disk 10. Also, the base plate 22 of the moving blade 20 that is adjacent with the tensioning key 30 has a crushing portion 22*a* that covers a portion of the tensioning key 30 (refer to FIG. 8). Note that this crushing portion 22*a* is formed by a portion of the base plate 22 being caulked.

Figure 9:
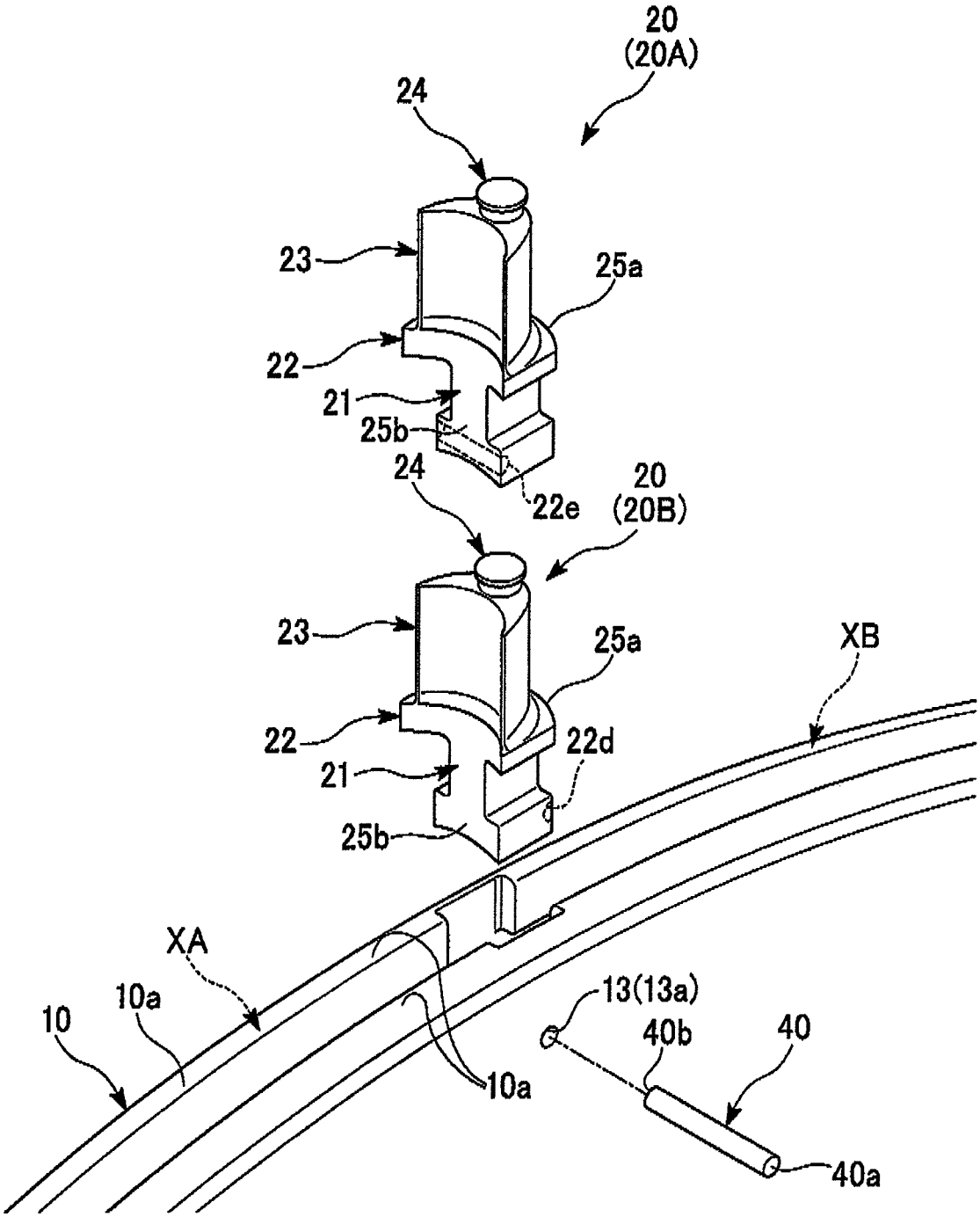
FIG. 9 is a first assembly explanation drawing of a rotating body 1 according to an embodiment of the present invention.

The end faces 25*a* and 25*b* in the circumferential direction that the blade root 21 and the base plate 22 constitute have an inverted T shape (refer to FIG. 6), and corresponding to the shape of the wing body 23, the one end face 25*a* has a convex shape in the circumferential direction, and the other end face 25*b* has a concave shape in the circumferential direction (refer to FIG. 9).

The wing body 23, as shown in FIG. 5 and FIG. 6, projects outward in the radial direction of the rotor disk 10, and the perpendicular cross section in the radial direction has a crescent shape (refer to FIG. 9).

Note that a tenon 24 to which a shroud 50 (refer to FIG. 2) is fixed is formed on the upper end surface of the wing body 23.

The special moving blades 20A and 20B are, as shown in FIG. 2, fixed mutually adjacently, with half of the respective blade roots 21 in the circumferential direction fitted in the moving blade fitting groove 11, and the remaining half positioned in the moving blade lead-in hole 12.

The blade roots 21 of the special moving blades 20A and 20B, as shown in FIG. 2 and FIG. 5, have semicircular grooves 21*d* and 21*e* that extend in the width direction (the axial direction of the rotor disk 10) in the inverted T-shaped end faces 25*a* and 25*b* that are mutually adjacent. As a result of the inverted T-shaped adjacent faces making close contact, the semicircular grooves 21*d* and 21*e* are put together, thus constituting the through-hole 21*c* that communicates with the insertion hole 13 (13*a* and 13*b*) of the rotor disk 10.

Figure 7:
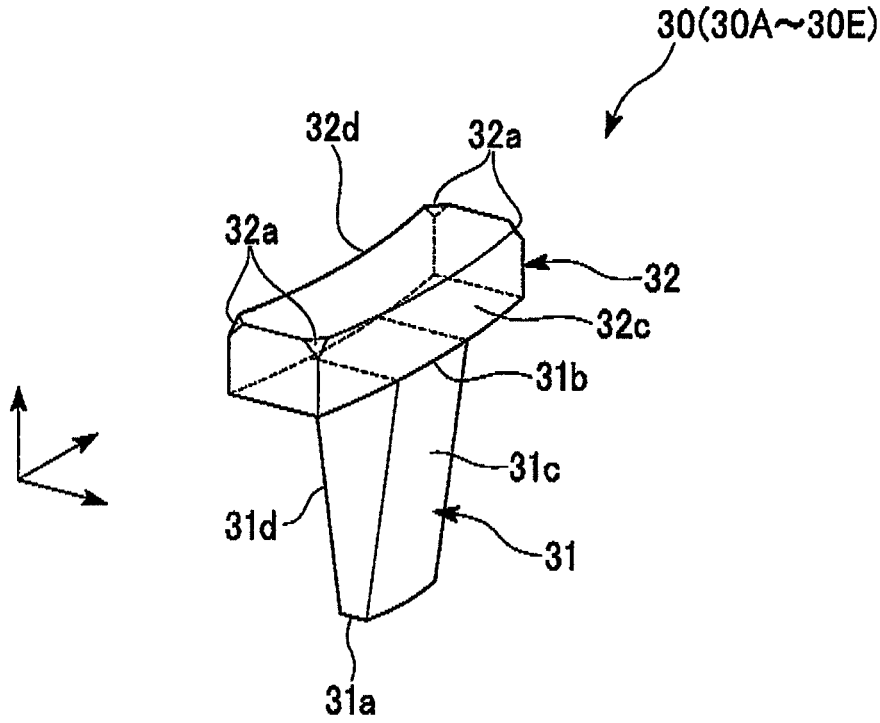
FIG. 7 is an outline external perspective view of a tensioning key 30 according to an embodiment of the present invention.

FIG. 7 is an outline external perspective view of the tensioning key 30 (30A to 30E).

As shown in FIG. 7, the tensioning key 30 (30A to 30E) has an insertion portion 31 and an extension portion 32.

The insertion portion 31, as shown in FIG. 7, curves in the circumferential direction, and one contact face 31*d* in the circumferential direction curves in a concave shape to be capable of making close contact with respect to the end face 25*a* of the moving blade 20 (the blade root 21 portion), and the other contact face 31*c* curves in a convex shape to be capable of making close contact with respect to the end face 25*b* of the moving blade 20 (the blade root 21 portion).

Also, as for this insertion portion 31, the thickness dimension in the circumferential direction of the rotor disk 10 has a tapered shape that gradually increases from the one end 31*a* toward the other end 31*b*, and it is inserted between the moving blades 20 from the one end 31*a* side.

In this kind of insertion portion 31, the width dimension in the axial direction of the rotor disk 10 is formed to be approximately the same as the groove width dimension of the moving blade fitting groove 11.

With such a constitution, the contact faces 31*c* and 31*d* in the circumferential direction of the insertion portion 31 make contact over the entire surface with the end faces 25*b* and 25*a* of the blade root 21 of the adjacent moving blades 20.

Figure 8:
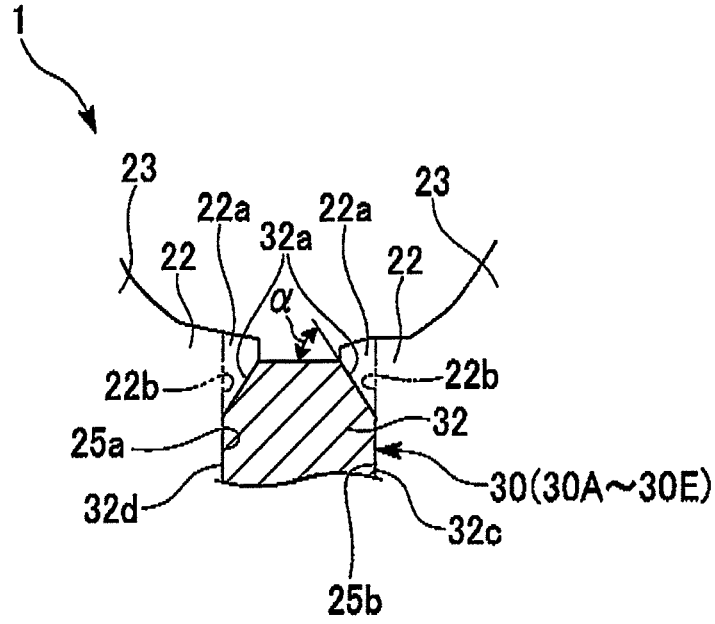
FIG. 8 is a principle portion enlarged cross-sectional view of a rotating body 1 according to an embodiment of the present invention, showing a tensioning key 30 and a moving blade 20 that is adjacent to this tensioning key 30.

FIG. 8 is a principle portion enlarged cross-sectional view of the rotating body 1, showing the tensioning key 30 and the moving blade 20 that is adjacent to this tensioning key 30.

The extension portion 32, as shown in FIG. 7, extends to both sides in the axial direction from the other end 31*b* of the insertion portion 31. This extension portion 32 curves in the circumferential direction similarly to the insertion portion 31, and the one end face 32*d* in the circumferential direction curves in a concave shape to make close contact with the end face 25*a* of the moving blade 20 (the base plate 22 portion), and the other end face 32*c* curves in a convex shape to make close contact with the end face 25*b* of the moving blade 20 (the base plate 22 portion).

The four corner portions of this extension portion 32 on the outer side in the radial direction are beveled portions 32*a*.

This beveled portion 32*a* is filled by the crushing portion 22*a* of the base plate 22 of the adjacent moving blade 20.

The bevel angle α of such a bevel portion 32*a* is preferably 50° to 70°. The reason for the bevel angle α being 50° or more is that, in the case of being less than 50°, the shear area 22*b* becomes excessively small and cannot withstand the centrifugal force during high speed rotation, leading to the risk of fracture. Also, the reason for the bevel angle α being 70° or less is that, in the case of being more than 70°, the centrifugal force that arises in the tensioning key 30 is not sufficiently transmitted to the crushing portion 22*a*.

The tensioning key 30 is formed with the same material as the moving blade 20, and has the same linear expansion coefficient. In the present embodiment, a heat resisting steel is used, but it is also possible to use another material (for example, stainless steel or the like).

The stop pin 40, as shown in FIG. 2 and FIG. 6, is fitted in the insertion hole 13 and the through-hole 21*c*, and both end portions 40*a* and 40*b* are crushed, whereby it is fixed in the rotor disk 10.

The shrouds 50 organize the plurality of moving blades 20 by dividing them into several groups by, in the state of the tenons 24 penetrating, the tenons 24 being caulked.

For the rotating body 1 that has the aforementioned constitution, in the case of the peripheral length at the outermost periphery end face 10*a* (refer to FIG. 2 and FIG. 5) of the rotor disk 10 being R, the total number of moving blades 20 and special moving blades 20A and 20B being Nb, the thickness dimension in the circumferential direction at the outermost portion of the blade root 21 of the moving blades 20 and special moving blades 20A and 20B being tb, the number of tensioning keys 30 being Nk, and the thickness dimension in the circumferential direction of the other end in the insertion portion 31 of the tensioning key 30 being tk, prior to assembling the rotor disk 10, the moving blades 20, the special moving blades 20A and 20B, and the tensioning keys 30, the following relations are satisfied:

$$R>Nb\times tb \quad (1)$$

$$R<Nb\times tb+Nk\times tk \quad (2)$$

Note that in the above-described embodiment, it is assumed that tk=tb/6.

Figure 10:
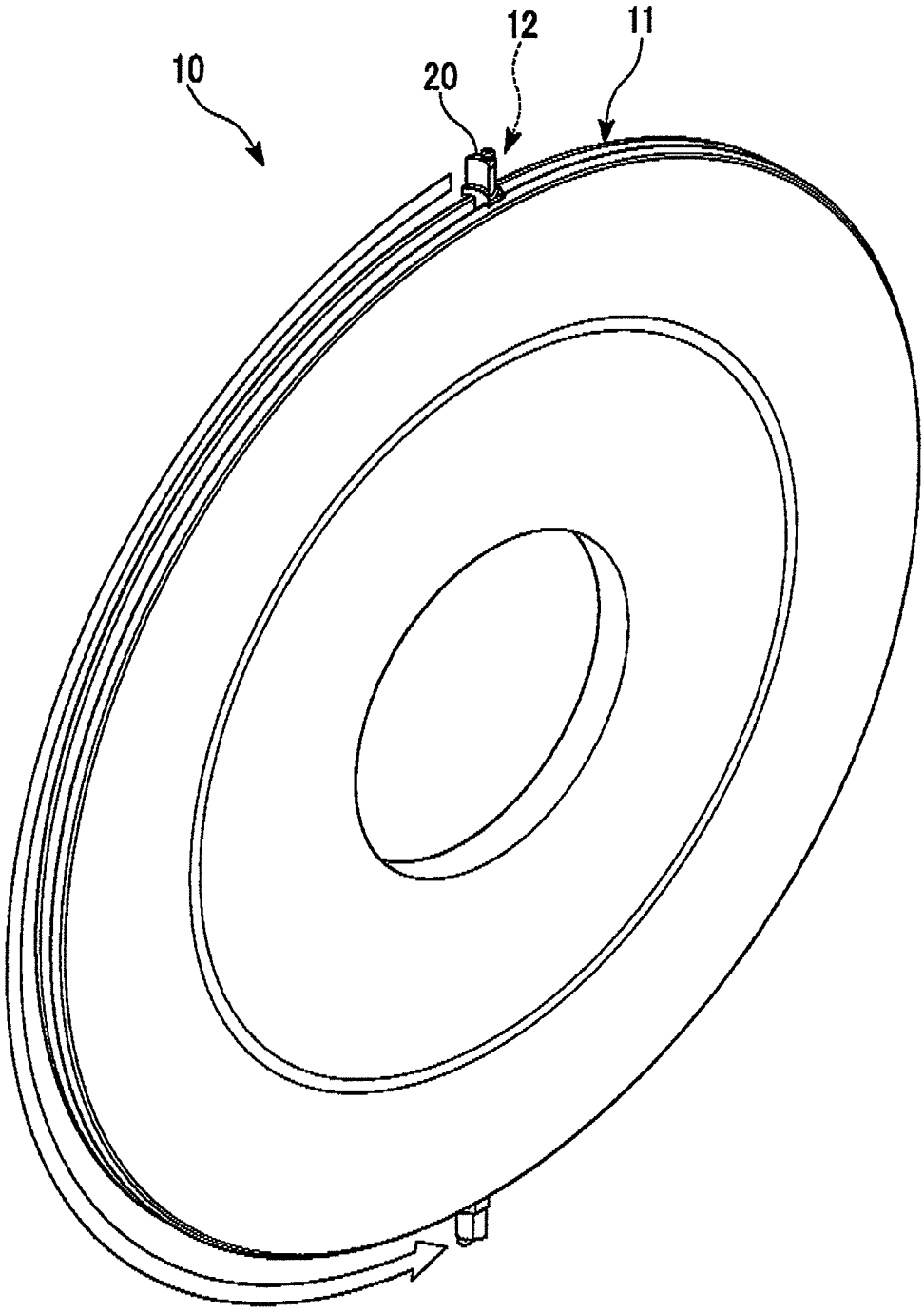
FIG. 10 is a second assembly explanation drawing of a rotating body 1 according to an embodiment of the present invention.

Next, the method of assembling the rotating body 1 with the aforementioned constitution shall be described. FIG. 9 and FIG. 10 are drawings for describing the assembly of the rotating body 1.

First, as shown in FIG. 9, the plurality of moving blades 20 are introduced to the moving blade lead-in hole 12 one at a time.

Next, the moving blade 20 that was introduced to the moving blade lead-in hole 12 is made to slide in the circumferential direction to cause the blade root 21 to be fitted in the moving blade fitting groove 11, and as shown in FIG. 2, the moving blade 20 is further made to slide in the circumferential direction. By repeating this operation, the space in the circumferential direction of the moving blade fitting groove 11 is filled in by the blade roots 21 of the moving blades 20, and the plurality of moving blades 20 are loaded.

Next, after the blade root 21 of the special moving blade 20B is fitted in the moving blade fitting groove 11 in the same manner as described above, the special moving blade 20B is made to slide in the moving blade fitting groove 11.

Next, the special moving blade 20A is introduced to the moving blade lead-in hole 12.

Next, the tensioning keys 30A and 30B are respectively fitted into the predetermined positions XA and XB. These predetermined positions XA and XB are determined so that a predetermined number of moving blades 20 belong to a major arc $A_L$ side (large arc) among the two periphery arcs partitioned by the predetermined positions XA and XB.

Next, by caulking the base plate 22 of each moving blade 20 that is adjacent to these two tensioning keys 30A and 30B, and filling the beveled portions 32*a* of the tensioning keys 30A and 30B with the crushing portion 22*a*, the tensioning keys 30A and 30B are fixed. At this time, the predetermined number of moving blades 20 that belong to a major arc $A_L$ are pressed by the tensioning keys 30A and 30B, and make close contact with the respectively adjacent moving blades 20. On the other hand, spaces that are slightly smaller than the three tensioning keys 30C to 30E are formed between the moving blades 20 and the special moving blades 20A and 20B that belong to a minor arc $A_s$.

Next, within the minor arc $A_s$ (short arc), the tensioning keys 30C to 30E are inserted between the moving blades 20 that are mutually adjacent in the circumferential direction. Specifically, the operation of inserting the tensioning keys 30C to 30E and the operation of fixing them by the crushing portion 22*a* is repeated from between the moving blades 20 positioned closest to the predetermined position XB side in sequence to the predetermined position XA side. At this time, each time the tensioning key 30 is inserted, the special moving blades 20A and 20B move tb/6 to the predetermined XA side.

When the insertion of all of the tensioning keys 30 is complete, the state as shown in FIG. 2 results in which half of each blade root 21 of the special moving blades 20A and 20B in the circumferential direction is fitted in the moving blade fitting groove 11, and the remaining half in the circumferential direction is positioned in the moving blade lead-in hole 12. In this state, the through-hole 21*c* overlaps with the insertion hole 13 in the axial direction.

Next, as shown in FIG. 9, after the stop pin 40 is inserted in the through-hole 21*c* and the insertion hole 13, as shown in FIG. 6, by crushing both end portions 40*a* and 40*b*, the stop pin 40 is fixed to the rotor disk 10.

Finally, as shown in FIG. 2, the tenons 24 are passed through the shrouds 50, and by caulking the tenons 24, the moving blades 20 are organized by being divided into several groups, and the assembly of the rotating body 1 is completed.

Next, the operation of the rotating body 1 that consists of the above-described constitution shall be described.

First, high pressure steam passes through the plurality of wing bodies 23, whereby rotative force is imparted to the rotating body 1. By this rotative force, centrifugal force is produced in each tensioning key 30. This centrifugal force is balanced by the frictional force with the two moving blades 20 that are adjacent to the tensioning key 30, and the shear load that occurs with the four crushing portions 22*a*.

The insertion portion 31 of this tensioning key 30 is strongly pressed by the two adjacent moving blades 20, and the contact faces 31*c* and 31*d* in the circumferential direction make contact over approximately the entire surface with the one end face of these two moving blades 20, and so the aforementioned frictional force increases.

Also, the four crushing portions 22*a* fill the beveled portions 32*a*, thus greatly ensuring the shear area 22*b*, and the allowable shear load increases.

That is, as a result of the rotating body 1 rotating at a high speed, even if a comparatively large centrifugal force acts on the tensioning key 30, it does not exceed the aforementioned increased frictional force and allowable shear load. That is, the crushing portion 22*a* does not break, and the tensioning keys 30 do not separate.

The stop pin 40 does not easily fall out since both ends are crushed, and continues to restrain the moving blades 20 and the special moving blades 20A and 20B in the circumferential direction.

By doing so, high speed rotation of the rotating body 1 and the rotor $R_O$ is continued.

As described above, according to the present embodiment, since the tensioning key 30 is provided with the insertion portion 31 whose thickness dimension in the circumferential direction gradually increases from the one end 31*a* to the other end 31*b*, it is possible to increase the contact area of the blade root 21 and the tensioning key 30. Thereby, it is possible to produce a large frictional force between the tensioning key 30 and the blade root 21, and it is possible to improve the fixing property of the tensioning key 30. Accordingly, even if the rotating body 1 is rotated at high speed, since looseness does not occur in the circumferential direction due to separation of the tensioning keys 30, it is possible to prevent separation of the moving blades 20 and the special moving blades 20A and 20B.

Also, since the insertion portion 31 has the contact faces 31*c* and 31*d* that make contact over the entire surface with the end faces 25*b* and 25*a* of the blade root 21, it is possible to further increase the frictional force that is produced between the tensioning keys 30 and the moving blades 20.

Also, since the aforementioned equations (1) and (2) are satisfied prior to assembling the rotor disk 10, the moving blades 20, the special moving blades 20A and 20B, and the tensioning keys 30, in the rotating body 1 after assembly, the tensioning keys 30, the moving blades 20, and the special moving blades 20A and 20B are respectively pressed, and by this pressing force it is possible to further increase the frictional force that is produced between the tensioning keys 30 and the moving blades 20.

Also, it is possible to allow large processing tolerances of the moving blades 20 and the special moving blades 20A and 20B.

Also, since both end portions 40*a* and 40*b* of the stop pin 40 are fixed by being crushed, the stop pin 40 does not easily fall out. Thereby, shifting in the circumferential direction and separation in the radial direction of the moving blades 20, the tensioning keys 30, and the special moving blades 20A and 20B in the case of separation of the stop pin 40 are prevented, and it is possible to improve the fixing property of the tensioning keys 30.

Also, since the moving blades 20, the special moving blades 20A and 20B, and the tensioning keys 30 are all formed with the same material, it is possible to further improve the fixing property of the moving blades 20, the special moving blades 20A and 20B, and the tensioning keys 30. That is, when the tensioning keys 30 are formed with a material that is softer than the moving blades 20, there is a possibility of looseness occurring in the circumferential direction as a result of deformation of the tensioning keys 30. On the other hand, when the tensioning keys 30 are formed with a material that is harder than the moving blades 20, there is a possibility of breakage of the moving blades 20. With the aforementioned constitution, it is possible to eliminate these possibilities and improve the fixing property of the tensioning keys 30, the moving blades 20, and the special moving blades 20A and 20B.

In other words, since the tensioning keys 30, the moving blades 20, and the special moving blades 20A and 20B are all made with a material having the same linear expansion coefficient, in the case of the rotor disk 1 becoming a high temperature, it is possible to prevent damage due to looseness and thermal stress of the moving blades 20 and the tensioning keys 30 that occurs due to differences in the thermal expansion amount, and so it is possible to improve the fixing property of the moving blades 20, the tensioning keys 30, and the special moving blades 20A and 20B.

Also, since the base plate 22 has the crushing portion 22*a* that covers the beveled portions 32*a* of the extension portion 32 of the tensioning keys 30, the crushing portion 22*a* prevents separation of the tensioning keys 30 in the radial direction. That is, it is possible to increase the centrifugal force that occurs in the tensioning keys 30 by the amount of the allowable shear load to the crushing portion 22*a*. Thereby, it is possible to greatly increase the fixing property of the tensioning keys 30.

Also, since the extension portion 32 has the beveled portions 32*a*, and the crushing portion 22*a* fills the beveled portions 32*a*, it is possible to largely ensure the shear area 22*b*, and it is possible to increase the allowable shear load of the crushing portion 22*a*.

Note that the operation procedure shown in the embodiment mentioned above, as well as the various forms and combinations of the constituent elements are examples, and various modifications can be made based on design requirements within a scope that does not depart from the spirit of the present invention.

Figure 11:
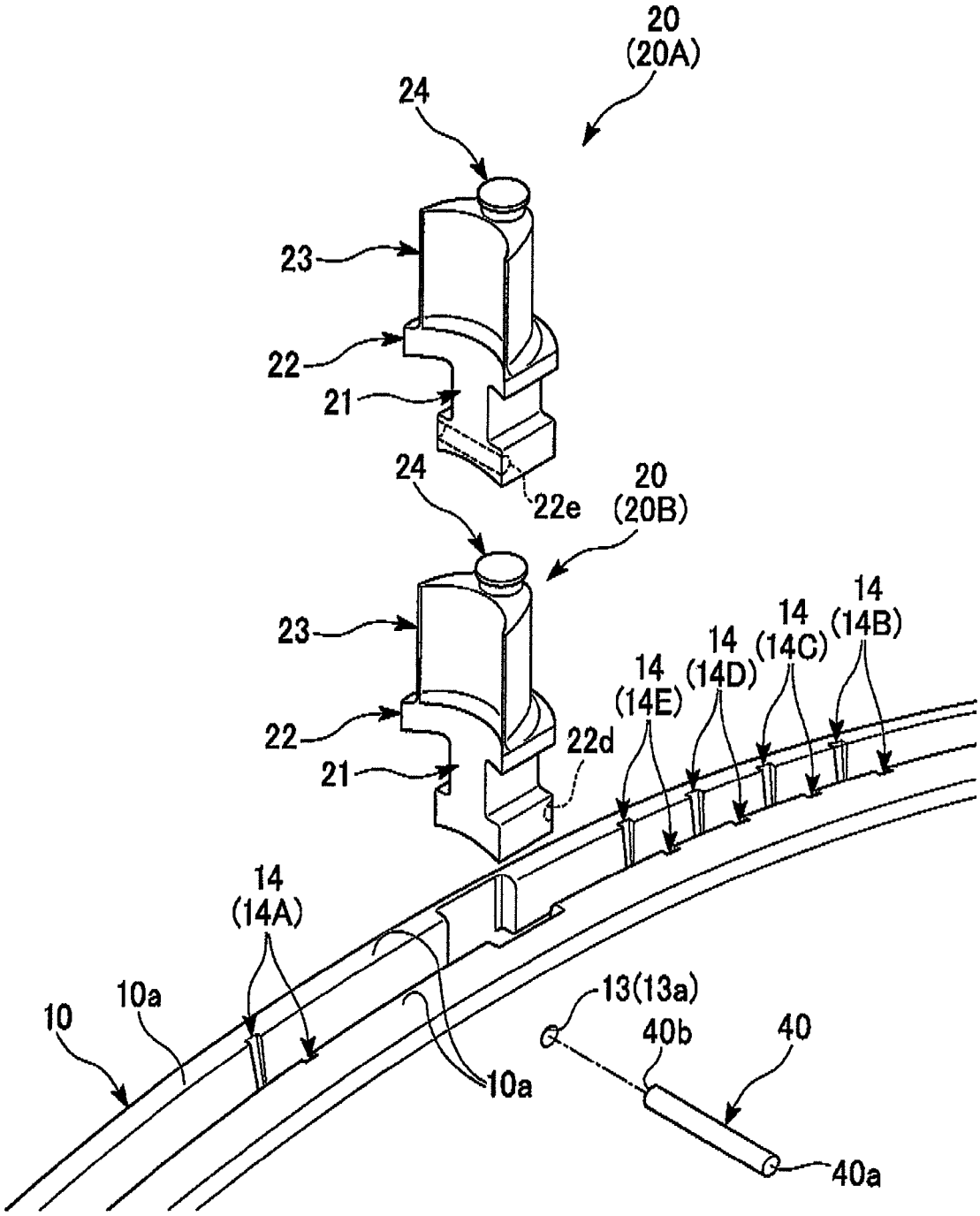
FIG. 11 is a principle portion enlarged perspective view that shows a modification of a rotating body 1 according to an embodiment of the present invention.

For example, as shown in FIG. 11, guide grooves 14 (14A to 14E) that allow fitting of the insertion keys 30 may be formed in advance in the side walls of the narrow width portion 11*a* of the moving blade fitting groove 11 at the position in which the tensioning key 30 is to be inserted. For example, the guide grooves 14A and 14B are formed at the predetermined positions XA and XB, and the axial direction dimension (width dimension) of the tensioning key 30 may be made slightly greater than the groove width dimension of the moving blade fitting groove 11.

According to this constitution, during assembly of the rotating body 1, it is possible to readily distinguish the position of inserting the tensioning keys 30, and moreover, by stipulating the range for performing position adjustment of the moving blades 20, it is possible to readily perform position adjustment of the moving blades 20 between the predetermined positions XA and XB (within the minor arc $A_s$ in FIG. 2).

Also, the guide grooves 14C to 14E may be formed in sequence separated by a gap of the thickness dimension tb of the blade root 21 from the guide groove 14B between the predetermined positions XA and XB (within the minor arc $A_s$ in FIG. 2).

Also, in the aforementioned embodiment, the contact faces 31*c* and 31*d* of the insertion portion 31 is formed in a curved shape in accordance with the shape of the blade root 21. But if the end faces 25*a* and 25*b* of the blade root 21 are formed in a planar shape, the contact faces 31*c* and 31*d* may be constituted to make contact over the entire surface by being formed in a planar shape. Similarly, it is possible to constitute the shape of the extension portion 32 may be constituted in accordance with the shape of the base plate 22.

Also, in the aforementioned embodiment, although the case of the rotating body 1 being formed separate from the rotor shaft S is described, it is also possible to apply the present invention to an integral construction in which the rotor shaft and the disk are cut from a forged steel ingot. Note that in the case of the rotating body 1 being formed separately from the rotor shaft S, they were integrated by shrink fitting, but a constitution may also be adopted in which they are integrated by another method.

Also, in the aforementioned embodiment, the constitution was adopted of inserting the tensioning keys 30 on both sides in the circumferential direction with the moving blade lead-in hole 12 serving as a reference, but a constitution may also be adopted of inserting the tensioning keys 30 on one side only.

Also, in the aforementioned embodiment, the constitution was adopted of the stop pin 40 being fixed to the rotor disk 10 by crushing both end portions of the stop pin 40, but by providing a head portion on one end, it is possible to adopt a constitution of crushing only the other end.

Also in the aforementioned embodiment, a stop pin 40 was used, but it is not always necessary to do so, and for example among the special moving blade 20A and the moving blade 20 that is adjacent to it, it is possible to adopt a constitution that provides an indentation that indents in the circumferential direction in one and a projecting portion that projects in the circumferential direction in the other, and so by causing them to engage prevents separation of the special moving blade 20A and the moving blade 20.

Also, in the aforementioned embodiment, a constitution was adopted in which the four corner portions on the outer side in the radial direction of the extension portion 32 serve as the beveled portions 32*a*, and these beveled portions 32 are filled by the crushing portion 22*a*, but in the case of there being four or more corner portions, all or a portion of the corner portions may be beveled portions, and a constitution may be adopted in which those beveled portions are filled with the crushing portion 22*a*.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A rotating body comprising:

a rotor disk that has a moving blade fitting groove that is annularly provided along an outer circumference and a moving blade lead-in hole that is provided in the outer circumference and is in communication with the moving blade fitting groove;

a plurality of moving blades that are consecutively provided in the outer circumference and that each have a blade root that is fitted in the moving blade fitting groove and a wing body that projects to the outer side of the rotor disk;

two special moving blades that each have a blade root and a wing body, wherein a portion of each blade root of the special moving blades is fitted in the moving blade fitting groove and each wing body of the special moving blades projects to the outer side of the rotor disk, the special moving blades being mutually adjoining so as to block the moving blade lead-in hole; and a tensioning key that is inserted between the moving blades, wherein the tensioning key is provided with an insertion portion whose thickness dimension in the circumferential direction gradually increases from one end on the inner side in the radial direction toward the other end on the outer side in the radial direction, and guide grooves in which the tensioning key is fitted so as to be fixed are formed in side walls of the moving blade fitting groove, and wherein the guide grooves are formed such that a width of the guide grooves in the circumferential direction gradually increases from one end on the inner side in the radial direction toward the other end on the outer side in the radial direction.

2. The rotating body according to claim 1, wherein the moving blades, the special moving blades, and tensioning key are formed with materials having the same linear expansion coefficient.

3. The rotating body according to claim 1, wherein the guide grooves in which the tensioning key is fitted are respectively formed in the side walls of the moving blade fitting groove such that the guide grooves oppose each other in the axial direction.

4. The rotating body according to claim 1, wherein adjacent faces of the blade roots of the two special moving blades have semicircular grooves that extend in the axial direction, and a through-hole that extends in the axial direction is constituted by these two semicircular grooves, the rotor disk, while having an insertion hole that penetrates the rotor disk in the axial direction and overlaps with the through-hole in the axial direction, is provided with a stop pin that is inserted in the through-hole and the insertion hole to restrain the plurality of moving blades in the circumferential direction, and the stop pin is fixed by at least one end portion thereof being crushed.

5. The rotating body according to claim 4, wherein the moving blades, the special moving blades, and tensioning key are formed with materials having the same linear expansion coefficient.

6. The rotating body according to claim 1, wherein the moving blades and the special moving blades are provided with a base plate that is provided between the wing body and the blade root, the tensioning key is provided with an extension portion that is provided at the other end of the insertion portion and that extends in the axial direction of the rotor disk, and the base plate has a crushing portion that covers a portion of the extension portion of the tensioning key that is adjacent.

7. The rotating body according to claim 6, wherein the extension portion is provided with beveled portions on outer side corner portions, and these beveled portions are filled by the crushing portion.

8. The rotating body according to claim 1, wherein the insertion portion has contact faces, which are surfaces of the tensioning key, that make contact over the entire surface with end faces, which are circumferential surfaces of the blade roots.

9. The rotating body according to claim 8, wherein the moving blades, the special moving blades, and tensioning key are formed with materials having the same linear expansion coefficient.

10. The rotating body according to claim 8, wherein adjacent faces of the blade roots of the two special moving blades have semicircular grooves that extend in the axial direction, and a through-hole that extends in the axial direction is constituted by these two semicircular grooves, the rotor disk, while having an insertion hole that penetrates the rotor disk in the axial direction and overlaps with the through-hole in the axial direction, is provided with a stop pin that is inserted in the through-hole and the insertion hole to restrain the plurality of moving blades in the circumferential direction, and the stop pin is fixed by at least one end portion thereof being crushed.

11. The rotating body according to claim 10, wherein the moving blades, the special moving blades, and tensioning key are formed with materials having the same linear expansion coefficient.

12. A rotating body comprising:

a rotor disk that has a moving blade fitting groove that is annularly provided along an outer circumference and a moving blade lead-in hole that is provided in the outer circumference and is in communication with the moving blade fitting groove;

a plurality of moving blades that are consecutively provided in the outer circumference and that each have a blade root that is fitted in the moving blade fitting groove and a wing body that projects to the outer side of the rotor disk;

two special moving blades that each have a blade root and a wing body, wherein a portion of each blade root of the special moving blades is fitted in the moving blade fitting groove and each wing body of the special moving blades projects to the outer side of the rotor disk, the special moving blades being mutually adjoining so as to block the moving blade lead-in hole; and tensioning keys that are inserted between the moving blades, wherein all of the moving blades, special moving blades and tensioning keys are arranged in the moving blade fitting groove of the rotor disk, wherein each tensioning key is provided with an insertion portion whose thickness dimension in the circumferential direction gradually increases from one end on the inner side in the radial direction toward the other end on the outer side in the radial direction, and guide grooves in which the tensioning keys are fitted so as to be fixed are formed in side walls of the moving blade fitting groove, wherein the guide grooves are formed such that a width of the guide grooves in the circumferential direction gradually increases from one end on the inner side in the radial direction toward the other end on the outer side in the radial direction, and wherein, in the case of the peripheral length of the rotor disk being R, the total number of the moving blades and the special moving blades being Nb, the thickness dimension in the circumferential direction at the outermost portion of the blade root of the moving blades and special moving blades being tb, the number of tensioning keys being Nk, and the thickness dimension in the circumferential direction of the other end in the insertion portion of the tensioning key being tk, prior to assembling the rotating body by assembling the rotor disk, the moving blades, the special moving blades, and the tensioning keys, the following relations are satisfied:

$$R>Nb\times tb$$

$$R<Nb\times tb+Nk\times tk.$$

13. The rotating body according to claim 12, wherein the moving blades, the special moving blades, and tensioning keys are formed with materials having the same linear expansion coefficient.

14. The rotating body according to claim 12, wherein adjacent faces of the blade roots of the two special moving blades have semicircular grooves that extend in the axial direction, and a through-hole that extends in the axial direction is constituted by these two semicircular grooves, the rotor disk, while having an insertion hole that penetrates the rotor disk in the axial direction and overlaps with the through-hole in the axial direction, is provided with a stop pin that is inserted in the through-hole and the insertion hole to restrain the plurality of moving blades in the circumferential direction, and the stop pin is fixed by at least one end portion thereof being crushed.

15. The rotating body according to claim 14, wherein the moving blades, the special moving blades, and tensioning key are formed with materials having the same linear expansion coefficient.

16. A rotating body comprising:

a rotor disk that has a moving blade fitting groove that is annularly provided along an outer circumference and a moving blade lead-in hole that is provided in the outer circumference and is in communication with the moving blade fitting groove;

a plurality of moving blades that are consecutively provided in the outer circumference and that each have a blade root that is fitted in the moving blade fitting groove and a wing body that projects to the outer side of the rotor disk;

two special moving blades that each have a blade root and a wing body, wherein a portion of each blade root of the special moving blades is fitted in the moving blade fitting groove and each wing body of the special moving blades projects to the outer side of the rotor disk, the special moving blades being mutually adjoining so as to block the moving blade lead-in hole; and tensioning keys that are inserted between the moving blades, wherein all of the moving blades, special moving blades and tensioning keys are arranged in the moving blade fitting groove of the rotor disk, wherein each tensioning key is provided with an insertion portion whose thickness dimension in the circumferential direction gradually increases from one end on the inner side in the radial direction toward the other end on the outer side in the radial direction, and guide grooves in which the tensioning keys are fitted so as to be fixed are formed in side walls of the moving blade fitting groove, wherein the insertion portion has contact faces, which are surfaces of the tensioning key, that make contact over the entire surface with end faces, which are circumferential surfaces of the blade roots, wherein the guide grooves are formed such that a width of the guide grooves in the circumferential direction gradually increases from one end on the inner side in the radial direction toward the other end on the outer side in the radial direction, and wherein, in the case of the peripheral length of the rotor disk being R, the total number of the moving blades and the special moving blades being Nb, the thickness dimension in the circumferential direction at the outermost portion of the blade root of the moving blades and special moving blades being tb, the number of tensioning keys being Nk, and the thickness dimension in the circumferential direction of the other end in the insertion portion of the tensioning key being tk, prior to assembling the rotating body by assembling the rotor disk, the moving blades, the special moving blades, and the tensioning keys, the following relations are satisfied:

$$R>Nb\times tb$$

$$R<Nb\times tb+Nk\times tk.$$

17. The rotating body according to claim 16, wherein adjacent faces of the blade roots of the two special moving blades have semicircular grooves that extend in the axial direction, and a through-hole that extends in the axial direction is constituted by these two semicircular grooves, the rotor disk, while having an insertion hole that penetrates the rotor disk in the axial direction and overlaps with the through-hole in the axial direction, is provided with a stop pin that is inserted in the through-hold the insertion hold to restrain the plurality of moving blades in the circumferential direction, and stop pin is fixed by at least one end portion thereof crushed.

18. The rotating body according to claim 17, wherein the moving blades, the special moving blades, and tensioning key are formed with materials having the same linear expansion coefficient.

* * * * *